United States Patent [19]

DeLucia

[11] 4,237,790

[45] Dec. 9, 1980

[54] MONORAIL RAPID TRANSIT SYSTEM

[76] Inventor: Thomas A. DeLucia, 280 Brady Ct., Sacramento, Calif. 95820

[21] Appl. No.: 956,674

[22] Filed: Nov. 1, 1978

[51] Int. Cl.[3] ..... E01B 25/12

[52] U.S. Cl. ..... 104/130; 104/120; 105/145

[58] Field of Search ..... 104/130, 118–120, 104/245, 246; 105/141, 144, 145

[56] References Cited

U.S. PATENT DOCUMENTS

| | | | |
|---|---|---|---|
| 3,822,648 | 7/1974 | Ishii et al. | 104/245 |
| 3,831,527 | 8/1974 | Peterson | 104/130 |
| 4,132,175 | 1/1979 | Miller et al. | 104/130 |

FOREIGN PATENT DOCUMENTS

| | | | |
|---|---|---|---|
| 1493577 | 11/1977 | United Kingdom | 104/130 |
| 1529060 | 10/1978 | United Kingdom | 104/119 |
| 499205 | 4/1976 | U.S.S.R. | 104/246 |

*Primary Examiner*—John J. Love

*Assistant Examiner*—Ross Weaver

*Attorney, Agent, or Firm*—Blair, Brown & Kreten

[57] ABSTRACT

A monorail rapid transit system including a plurality of cars coupled together to form a train and supported for travel on a main track comprising a pair of upstanding rails arranged in spaced-apart parallel relationship and including an auxiliary track diverging obliquely from one side of the main track at an intersection and having one rail in common with one rail of the main track, each of the cars including at least one pair of retractable guide arms pivotally movable into guiding engagement with the rails on opposite sides of the track together with a central guide member on the car accommodated between the rails for guiding engagement therewith, whereby pivotal movement of the arms selectively into engagement with only one of the rails permits the car to be guideably directed either on the main track or onto the auxiliary track when passing through the intersection.

9 Claims, 8 Drawing Figures

MONORAIL RAPID TRANSIT SYSTEM

BACKGROUND OF THE INVENTION

The popularity of the monorail system of transportation, particularly public transit, has steadily increased with time bringing with it certain limitations which have constantly sought to be overcome. For instance, the concomitant increase in passenger load has brought into focus the need for loading and unloading passengers without imposing undue interruptions and delays in train schedules. In multi-car monorail systems some attempts have been made to divert one or more passenger cars from a multi-car train onto side tracks serving passenger stations or the like. However, such a prior art system usually requires either a separate track paralleling the main track and/or a very complicated track mounted switching system. All such present day systems fail to measure up to desired standards for handling large passenger/loads and are usually prohibitive in cost.

OBJECTS AND SUMMARY OF THE INVENTION

A primary object of this invention is to provide a new and novel monorail rapid transit system in which a multi-car train maybe simply and easily uncoupled to divert one or more cars onto an auxiliary track while continuing to travel along a main track.

Another object of this invention is to provide a new and novel guiding arrangement for a monorail car which permits the car to selectively continue on a new track or to be diverted onto an auxiliary track extending obliquely from either side of the main track at an intersection.

Still another object of the invention is to provide a new and novel monorail rapid transit system which is simple and inexpensive in construction, which is highly efficient in operation and which permits one or more cars of a multi-car train to be shunted between a main track and an auxiliary track associated with a station for rapid loading and unloading of passengers during the travel of the train.

The objects of the invention and other related objects are accomplished by the provision of a main track having a pair of spaced-apart rails on the upper ends of which one or more cars coupled together are supported for travel, an auxiliary track of the same construction diverging from one side of the main track and having one rail in common with the rail of the main track on the side from which the auxiliary track extends. Each car is provided with at least one guide means including a central guide member for accommodation within the space between the rails in guiding engagement with the inner side walls of the rails and a pair of retractable guide arms on opposite sides of the track pivotably movable selectively between a retracted position under the car above the upper level of the rails and an operative position in guiding engagement with either one or both of the outer side walls of the rails so that the car continues along the main track at the intersection with the auxiliary track or is guidably diverted onto the auxiliary track connected to the main track at the intersection.

Other objects and advantages will become apparent in the following specification when considered in light of the attached drawings.

DESCRIPTION OF THE PREFERRED EMBODIMENT

Figure 1:
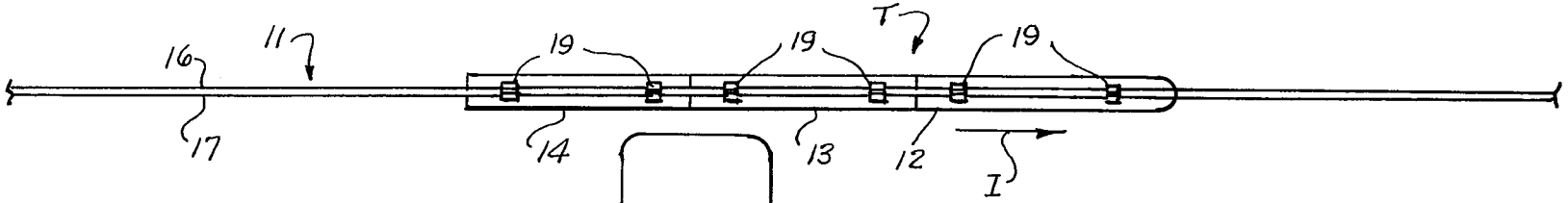
FIG. 1 is a plan view of a plurality of cars coupled together to form a train traveling on a track constructed in accordance with the invention.

Referring now to FIG. 1 there is shown a train designated generally by the letter T arranged to travel on a track 11 in the direction of the arrow I. The train T is in the form of one or more cars and in the illustrated embodiment three of such cars 12, 13, 14 are shown coupled together in end-to-end relationship in any conventional manner.

Figure 2:
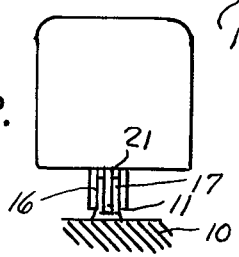
FIG. 2 is an enlarged end view of the train of FIG. 1.

As shown in FIG. 2, the track 11 is of the monorail type and is formed of a pair of rails 16, 17 arranged in spacedapart, parallel relationship. The track 11 is arranged to be supported in any suitable manner on a supporting surface 18 such as a roadbed or the like. The cars, 12, 13, 14 are arranged to be supported on the rails 16, 17 as will be explained hereinafter, and each car includes one or more guide means guideably engaging the rails 16, 17 during the travel of the train in the direction of the arrow I. More specifically, each of the cars 12, 13 and 14 include at least one, preferably two guide means designated generally by the numeral 19.

More specifically, the guide means 19 include a guide member 21 extending downwardly from the underside of the car for accommodation within the space or gap between the rails 16, 17 in guiding engagement with the side walls defining the gap. The guide means also includes a pair of retractable arms 22, 23 mounted preferably on the underside of the car for movement between a retracted position in underlying relationship with the car such as arm 22 in FIG. 4 and an operative position as shown in FIG. 2 in guiding engagement with the side wall of the other sides of the rails 16, 17.

Figure 3:
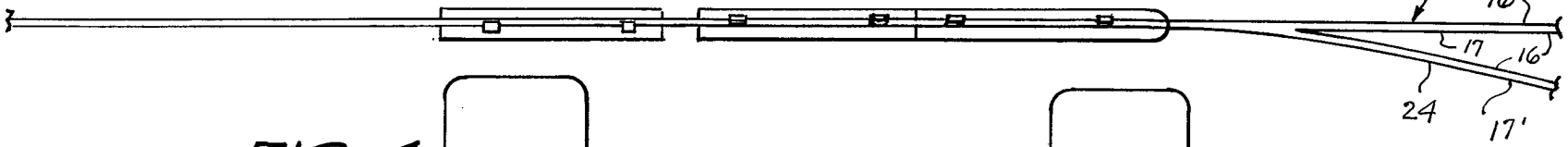
FIG. 3 is a view similar to FIG. 1 with the rearmost car in an uncoupled position with the train approaching an intersection in the track.
Figure 5:
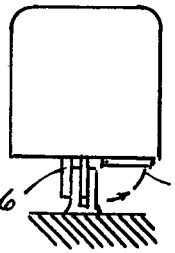
FIG. 5 is a view similar to FIG. 2 showing the parts of the remaining cars in the train for travel through the intersection.

As generally illustrative of the invention, the train T travels along the track 11 in the direction of the arrow I as shown in FIG. 1 with the retractable arms 22,23 extending downwardly in guiding engagement with the sides of the rails 16,17 respectively as shown in FIG. 2. As the train T approaches an intersection in the track as defined by the main track 11 and an auxiliary track 24 diverging or branching off one side of the main track 11, the rear car 14 is uncoupled as shown in FIG. 3 so as to separate from the main part of the train T comprising cars 12, 13. At this time, the retractable arm 23 of the guide means 19 on cars 12, 13 moves above the upward edge of track 11 as shown in FIG. 5. Arm 22 of the guide means 19 on cars 12,13 continues to travel through the intersection from the main track 11 being guided only by rail 16.

The arms 22, 23 may be moved pivotally by a suitable means carried by the car on which the arms are mounted. For instance, the actuating mechanism for the arms can be any suitable type of hydraulically or electrically operated mechanism such as the retractable landing gear of a modern aircraft with similar locking and safety devices.

Figure 4:
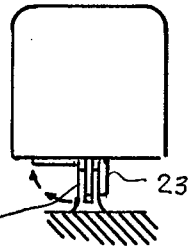
FIG. 4 is a view similar to FIG. 2 illustrating the parts of the uncoupled car of FIG. 3 for routing the uncoupled car onto the intersecting tracks.
Figure 6:
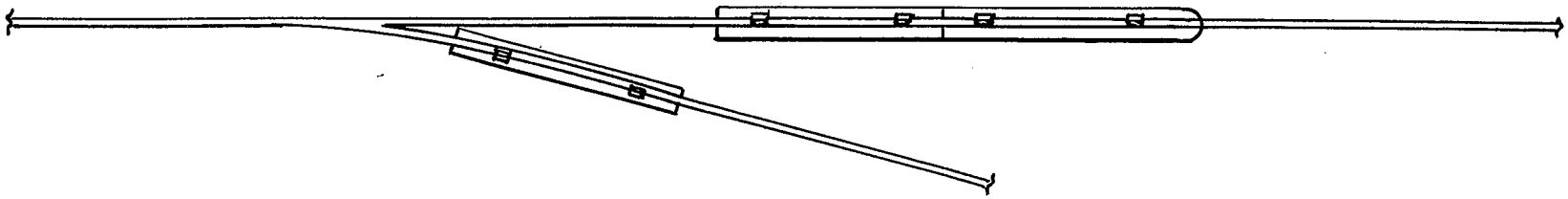
FIG. 6 is a plan view similar to FIG. 1 illustrating the position of the uncoupled car and the remaining cars in the train after passing through the intersection.

On car 14, the retractable arm 22 of the guide means 19 is pivoted upwardly into the retractable position in underlying relationship with the car 14 with arm 23 remaining in a downward position in guiding engagement with the outer side of rail 17 as shown in FIG. 4. Thus, as car 14 approaches the intersection it moves onto the auxiliary track 24 being guided by engagement between the guide member 21 and arm 23 with the rail 17 which merges into rail 17' on the auxiliary track 24 as shown in FIG. 6.

When both cars 12, 13 have moved through the intersection on main track 11 and car 14 has moved through the intersection onto auxiliary track 24, the retractable arms 22,23 are returned to the operative position in engagement with the rails 17, 16' respectively for further travel of the coupled cars 12,13. Car 14 may utilize any type of propulsion unit such as electrically operated traction motors, electromagnetic motive devices, pressurized air propulsion systems and the like. The arrangement of the invention lends itself particularly to a transportation system which comprises an express train and a local train. As an example, car 14 can be considered a transfer car for passengers and is preferably self-propelled. For instance, passengers wishing to disembark at a station served by the auxiliary track 24 would move from cars 12,13 to the transfer car 14 which would be subsequently disengaged as shown in FIG. 3.

With the positioning of the guide means 19 of the various cars as explained above, the transfer car 14 moving onto auxiliary track 24 would stop at a station served by track 24 to permit the passengers to be unloaded. At this time, the main portion of the train represented by cars 12, 13 would continue on the main track 11. Another transfer car which has left the station served by track 24 with passengers may then connect up with the main track 11 at which time the passengers would move from the new transfer car to the cars 12,13 of the main part of the train.

Figure 7:
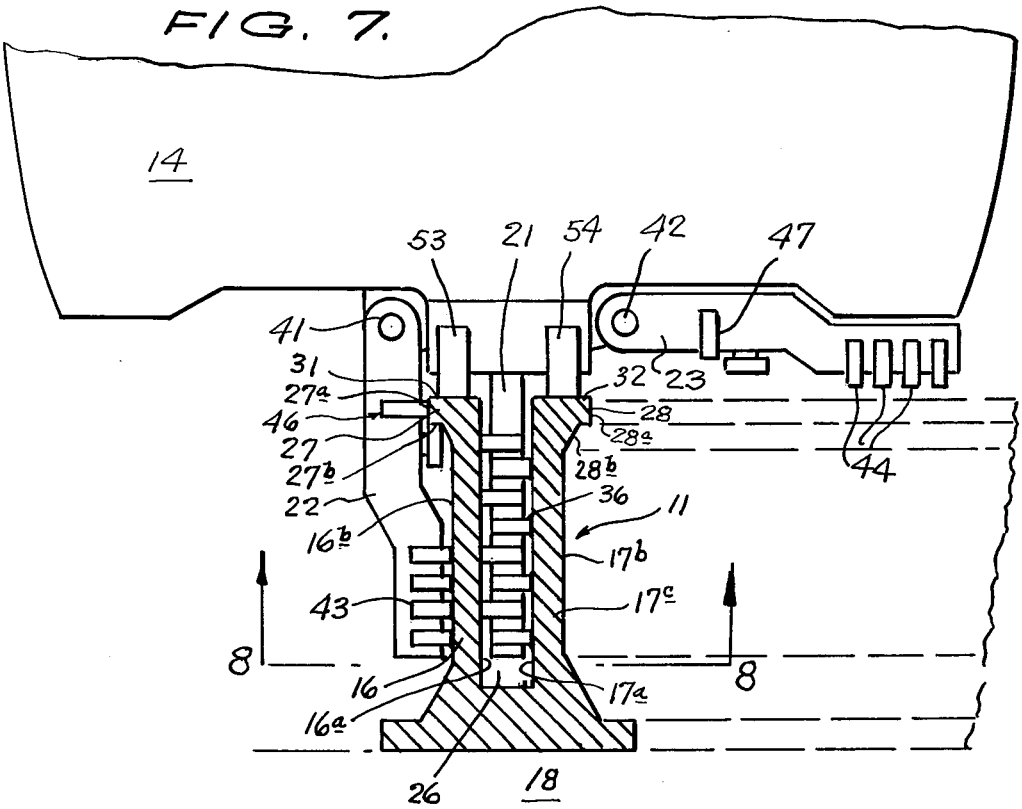
FIG. 7 is an enlarged view partially in section of the component parts of the invention in the position of FIG. 5.
Figure 8:
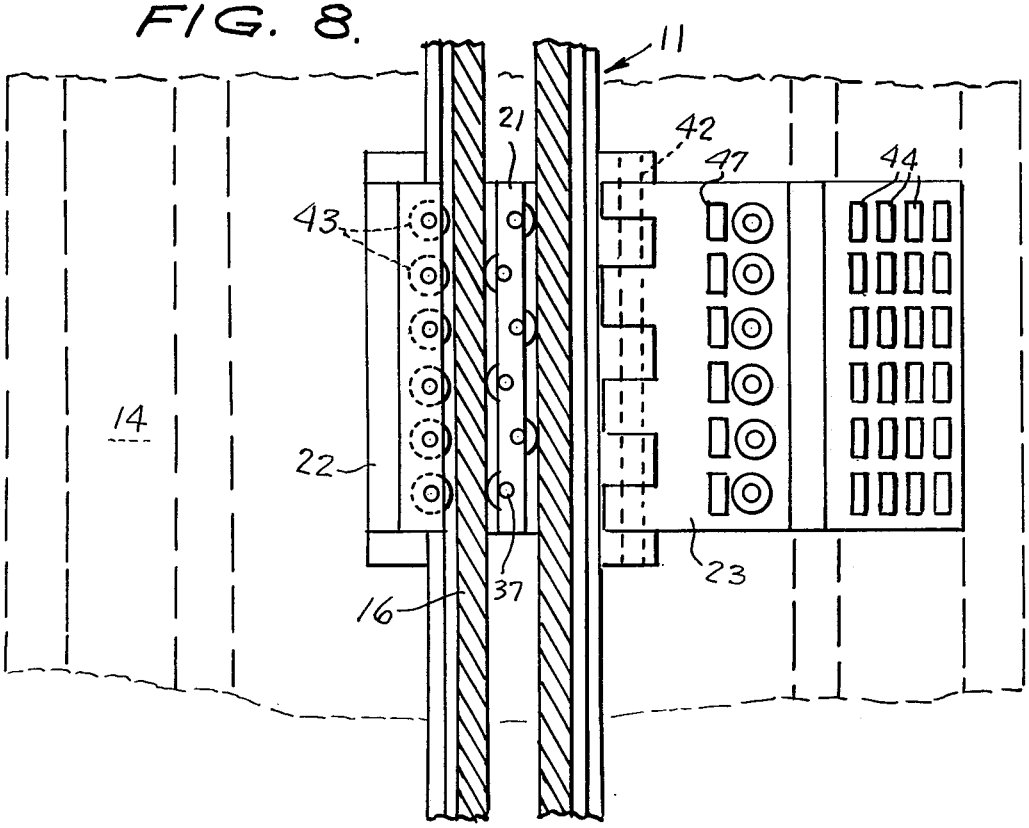
FIG. 8 is a sectional view taken substantially along line 8—8 of FIG. 7 in the direction of the arrows.

Referring now to FIGS. 7, 8 there is shown in detail the component parts which form each of the guide means 19 for the cars 12, 13 and 14, the lower portion of car 14 being shown in FIG. 7. The track 11 which is preferably formed as an integral unit includes the rails 16, 17 which define a gap clearance space 26 therebetween for accommodating the downwardly extending guide member 21. The guide rails 16, 17 are formed at their upper ends with laterally extending portions 27, 28 respectively forming upper ledges 31,32 respectively. Means are provided for supporting the car 14 on the ledges 31,32 which include a pair of spaced rollers 53,54 suitably mounted for rotation on the underside of car 14 as shown. Guide member 21 which extends downwardly into the gap 26 is provided with a plurality of rollers 36 mounted for free rotation on bearings 37 and in staggered relationship for rolling relationship with the side walls **16*a*, 17*a***.

Each of the arms 22, 23 is mounted for pivotal movement between the retracted position illustrated by arm 23 in FIG. 7 and the operative position illustrated by arm 22 in FIG. 7. By means of rods 41, 42 in a hinge structure shown best in FIG. 8, each of the arms 22, 23 are provided with a plurality of freely rotatable rollers 43,44 respectively which are preferably arranged in vertically spaced relationhip in a plurality of rows as shown best in FIG. 8. Thus, when the arms 22,23 are moved into the operative position the roller 43 guideably engages the outer sides **16*b*,17*b* of the rails 16,17 for guiding the movement of the car 14 in association with the guide member 21 on the main track 11 or on the auxiliary track 24 as explained above, the arms 22, 23 may be moved selectively into an operative position so that the appropriate car may pass through an intersection in the track. Preferably, each of arms 22,23 are also provided with roller means 46,47 respectively which in the illustrated embodiment, provides a pair of freely rotateable rollers which engage the surfaces 27*a*,27*b* of rail portion 27 and surfaces 28*a*,28*b* of rail portion 28 as illustrated by the position of the roller means 46 of arm 22 in FIG. 7**.

Having thus described the preferred embodiment of the invention it should be understood that numerous structural modifications and adaptations may be resorted to without departing from the spirit of the invention.

What is claimed is:

1. A monorail transit system comprising, in combination, a single main track, a single auxiliary track diverging obliquely from one side of said main track and having one side in common with one side of said main track, a car supported for travel on said main track and said auxiliary track a pair of guide means on said car for guiding engagement with said track, said pair of guide means including independently retractable means disposed on opposite sides of said track each selectively and independently moveable between a retracted position out of engagement with the associated side of said track and an operative position in guiding engagement with said associated side of said track to permit said car to travel onto said auxiliary track or to continue on said main track whereby said pair of guide means may be simultaneously actuated to provide stability on the main track, or singly actuated for turning onto the auxiliary track.

2. A monorail transit system in accordance with claim 1 including a plurality of said cars detachably connected together to form a train, said retractable means on each said car being selectively operable to permit one of said cars when detached to travel onto said auxiliary track and the other plurality of cars to continue to travel on said main track.

3. A monorail transit system in accordance with claim 1 wherein said single main track comprises a pair of rails having a common integral base portion disposed in spaced-apart parallel relationship to define a gap therebetween and wherein said guide means includes a guide member secured to the underside of said car and extending downwardly for accommodation within said gap during the travel of said car on said main and said auxiliary tracks and means on said guide member for guiding engagement with inner side walls of said rails.

4. A monorail transit system in accordance with claim 3 wherein said guiding means on said guide member includes a plurality of rollers mounted in at least one vertically spaced-apart group for free rotation for rolling engagement with said inner side walls of said rails.

5. A monorail transit system in accordance with claim 4 wherein the upper ends of each of said rails include a laterally extending portion defining a pair of ledges, and including a pair of transversely spaced rollers mounted on the underside of said car for rolling engagement with said ledges to support said car on said rails.

6. A monorail transit system in accordance with claim 5 wherein said retractable means include a pair of arms each independently pivotally mounted at one end on the underside of said car on opposite sides of said guide member for accommodating said track therebetween, each of said arms being pivotally moveable between said retracted position in proximate relationship with the underside of said car and into said operative position in substantially parallel relationship with its associated side of said track.

7. A monorail transit system in accordance with claim 6 including a plurality of rollers mounted for rotation in at least one vertically spaced-apart group on each of said arms adjacent to the other ends of said arms, said rollers on said arms being arranged for rolling engagement with the associated side of said track in the operative position of said arms.

8. A monorail transit system in accordance with claim 7 including at least one roller means on said arms guideably engageable with the outer surfaces of said laterally extending portions of said rails when said arms are in the operative position.

9. The device of claim 8 wherein further rollers are provided on said arms which engage a bottom surface of said laterally extending portion of said rails when said arms are in an operative position to provide greater stability when the train is in transit.

* * * * *